US006123656A

United States Patent [19]

Michelsen

[11] Patent Number: 6,123,656

[45] Date of Patent: Sep. 26, 2000

[54] DECANTER CENTRIFUGE

[75] Inventor: Jan Michelsen, Middelfart, Denmark

[73] Assignee: Incentra, Middelfart, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,862

[22] PCT Filed: Nov. 6, 1995

[86] PCT No.: PCT/DK95/00440

§ 371 Date: Aug. 4, 1997

§ 102(e) Date: Aug. 4, 1997

[87] PCT Pub. No.: WO96/14935

PCT Pub. Date: May 23, 1996

[30] Foreign Application Priority Data

Nov. 9, 1994 [DK] Denmark ..... 94/1291

[51] Int. Cl.[7] ..... B04B 1/20

[52] U.S. Cl. ..... 494/54; 494/81

[58] Field of Search ..... 494/50–54, 81, 494/85; 198/659, 660, 676; 210/380.1, 380.3

[56] References Cited

U.S. PATENT DOCUMENTS

| | | | |
|---|---|---|---|
| 2,174,857 | 10/1939 | Vogel-Jorgensen | 494/54 |
| 3,797,737 | 3/1974 | Kadotani et al. | 494/81 |
| 3,823,869 | 7/1974 | Loison | 494/81 |
| 3,844,730 | 10/1974 | Laussermair | 494/81 |
| 4,298,161 | 11/1981 | Ephithite | 494/81 |
| 4,468,269 | 8/1984 | Carey | 494/81 |
| 4,828,541 | 5/1989 | Madsen . | |
| 5,234,400 | 8/1993 | Kluge | 494/54 |
| 5,584,791 | 12/1996 | Grimwood et al. | 494/54 |
| 5,687,832 | 11/1997 | Thiessen | 198/676 |

FOREIGN PATENT DOCUMENTS

| | | | |
|---|---|---|---|
| 1152366 | 8/1963 | Germany | 494/81 |
| 1243594 | 6/1967 | Germany | 494/81 |
| 2140331 | 3/1972 | Germany | 434/81 |
| 2453650 | 5/1975 | Germany | 494/81 |
| 48-30431 | 9/1973 | Japan | 494/81 |
| 49-38671 | 10/1974 | Japan | 494/81 |
| 51-4675 | 1/1976 | Japan | 494/81 |
| 93//22062 | 11/1993 | WIPO . | |

*Primary Examiner*—Charles E. Cooley
*Attorney, Agent, or Firm*—Pennie & Edmonds LLP

[57] ABSTRACT

A decanter centrifuge (1) has a rotor comprising a helical conveyor (2) and a drum (20). The conveyor (2) comprises a conveyor hub (3) and helical flights (4), and the drum comprises an inner shell (21) of steel and an outer shell (22) of fiber reinforced plastic. The conveyor (2) consists of a shaft of tube form (11), primarily made from carbon fiber reinforced resin, and helical flights (4), primarily made from polyurethane. The flights (4) of the helical conveyor are formed in such a way that they all the time is in contact with the inner periphery of the drum (31). The division of the drum in an inner and an outer shell causes the mass of the drum to be reduced considerably.

11 Claims, 3 Drawing Sheets

DECANTER CENTRIFUGE

This application is the national phase of international application PCT/DK95/00440 filed Nov. 6, 1995 which designated the United State.

BACKGROUND OF THE INVENTION

1. Field of the Invention

This is invention relates to a decanter-type centrifuge for the separation of suspended solids from a liquid medium, the centrifuge comprising a drum and a helical conveyor rotatable mounted therein, said helical conveyor having a conveyor hub and at least one helical flight.

2. Prior Art

Conventionally, a decanter-type centrifuge (hereinafter referred to as a decanter centrifuge) comprises a hollow drum of cylindrical/conical cross-section rotatably supported by bearings and having a helical conveyor therein, rotatably supported by bearings relative to the drum. Such a centrifuge is primarily used for the separation of solid particles from sludge, i.e. sludge from sewage treatment plants.

The centrifuge works by having the materials to be separated introduced within the drum through a pipe along the conveyor's axis of rotation via an inlet arrangement. As the centrifuge rotates, the introduced sludge forms a toroidal shaped volume along the inner wall of the drum. By action of the centrifugal forces, the solid particles are concentrated as a layer along the inner wall of the drum, and from there they are transported by the helical conveyor towards one end of the centrifuge. Typically, the end of the conveyor is formed as a frustro-cone with a narrow end having approximately the same diameter as the inner diameter of the toroidal-formed sludge volume, whereby the solids leave the centrifuge having a comparatively higher concentration of solids than the incoming sludge. At the end of the centrifuge, the cleaned liquid phase leaves the centrifuge through holes or special extraction means, such as a paring device.

A centrifuge has a limited peripheral speed, fixed by material properties and stresses created by the rotation, and the internal toroidal volume is limited by the maximum length of the drum, which limit is primarily governed by the tendency of increased vibrations as the operational speed gets close to a critical frequency of vibration. Critical vibration frequencies are a property, mainly fixed by the stiffness-to-weight ratio of a body. The lowest ratio for the parts of a decanter centrifuge is found at the helical conveyor.

Known decanter centrifuges often have longitudinally mounted strips along the inner wall of the drum, intended to protect the inner wall from wear by the solids in the following way. By the action of the centrifugal forces, a layer of solid particles is deposited on the wall, which layer will be out of reach of the helical conveyor and held in position against rotation relative to the drum wall by the strips. By this method, some degree of self-sealing between the helical edge and the fixed layer of solid particles will be created.

The capacity of a decanter centrifuge is mainly dependent on two properties: the maximum safe operational rotational speed, and the size of the toroidal volume of liquid and solids contained in the drum.

The functional lifetime of a decanter centrifuge is limited by wear from the solids being conveyed, partly caused by the friction created by the transport action itself, and partly caused by friction between the peripheral edge of the conveyor against the hard and often sharp particles concentrated at high density between the strips along the drum wall during the operation of the centrifuge.

As the flights of the helical conveyor are worn along their edges, the effective volume of separation is reduced accordingly, thus reducing the separation capacity of the centrifuge.

Decanter centrifuges of the foregoing type are known to have several different design features and variations.

The limitations originating from critical frequencies and vibrations have given rise to several complicated designs, e.g., letting the helical conveyor be supported by the medium to be treated instead of being supported in rigid bearings.

Danish Patent No. 15450 shows a decanter centrifuge with a helical conveyor comprising a hollow hub with flights having an overall density less than the density of the lighter phase of the medium to be treated. In this way, the influence of the stiffness/weight ratio of the conveyor on the tendency to create vibrations is eliminated, thus making it possible to increase the safe operational speed of the centrifuge.

The disadvantages of this arrangement in a centrifuge are that the bearings supporting the conveyor are flexible, thereby making it difficult to transfer the necessary torque and forces to the conveyor from the drive system, thus limiting the conveying capacity. Furthermore, the risk of having deposition of the separated material along the inner wall of the drum in a non-coaxial manner is increased, thus causing the centrifuge to be prone to vibrations.

A large number of inventions have been made to deal with wear problems, and most of these have attempted to improve the wear resistance in highly loaded wear zones.

The latest approaches have been oriented towards the flights of the conveyor. WO 93/22062 describes a decanter centrifuge with helical flights that have wear resistant rubber protection mounted at their peripheral edges in such a manner that the rubber profile seen in axial cross-section has a different angle to the axis than the flights themselves.

SUMMARY OF THE INVENTION

The aim of the present invention is therefore to provide a decanter-centrifuge of the type having a drum and a rotatable helical conveyor mounted therein which is safe in operation, which, with mainly the same dimensions, has a larger separation capacity than known before, and which moreover is simple and inexpensive to manufacture.

These advantages are obtained through characteristic properties of the invention, in which at least the helical flight of the conveyor is manufactured from an elastomeric material, e.g., polyurethane.

As described above, in order to increase the separation capacity of a centrifuge, it is necessary to increase the length and/or the rotational speed of the rotor. A decanter centrifuge according to the invention can increase both the length and the rotational speed without sacrificing the technical safety of operation.

The length increase is possible because both the drum and the conveyor are manufactured from materials that are relatively light and stiff compared to conventional materials, thus improving the ratio of stiffness to weight.

The hub of the conveyor, including the feed inlet for the sludge, is in a preferred embodiment made of the same material as the helical flight, and the stiffness of the conveyor is increased by a cast-in pipe, reaching from one end of the conveyor to the other between the bearings which support the conveyor. The combination of the light materials used for the hub and flight, and the light and stiff material of the pipe, produces a conveyor of a previously unknown stiffness-to-weight ratio, by which a considerable increase of the conveyor's length and/or a considerable increase of the 1st critical frequency of the conveyor is possible.

As a consequence of an increased rotational speed, conventional rotors are prone to increased friction and wear of the helical flights against the inside wall of the drum, resulting in a decreasing lifetime of the centrifuge. This is primarily caused by the deposited layer of heavy and hard particles between the strips. Further, the pressure between the peripheral edge of the helical flights and the deposited particles becomes very large, further increasing the resistance and wear.

The present invention is distinguished, however, by the fact that this problem does not arrive, even at very high rotational speeds. The very characteristic that the helical flights of the conveyor are made from a flexible material and at the same time are in contact with the inner wall of the drum prevents the formation of a "protection" layer between the peripheral parts of the flights and the inside of the drum. Thus, no heavy, hard particles can be deposited and retained between the flights and the inside wall of the drum, and the high pressures creating wear are not present. Further, the flexible material of the flights yields to particles that may be trapped, thus preventing excessive wear.

By letting the helical flights be in contact with the inner wall of the drum, an increase in operational safety is obtained, as solid matter is no longer permitted to be deposited non-coaxially so as to cause vibrations. By letting the helical flights be composed of an elastomer, and by making them to have an angle relative to the inner wall of the drum different from 90 degrees, it is a result that the flights, even after some wear at the edge, will be in contact with the inside wall of the drum, and at the same time, the wear of the flights will be decreased considerably, because they are in contact with a smooth wall instead of a layer of deposited, hard particles.

Furthermore, the separation volume of the centrifuge will be unchanged throughout its lifetime, and the same is true for its separation capacity.

To further decrease the wear of the flights and increase the lifetime of the centrifuge, the profile of the inner wall in cross-sectional view is formed as a gradually converging transition from a cylindrical outline at the liquid inlet end to a conical outline at the solids' outlet from the drum whereby at every point along the profile, the wear inducing forces are minimized, in particular in the most critical places, i.e. at the feed introduction point.

Furthermore, considerable savings are obtained regarding manufacturing, as the conveyor is castable in a simple mold, and intensive machining processes have been eliminated or replaced by modern fiber technology.

In a preferred embodiment, the conveyor hub and the helical flights are made of only one material. This requires a very large-diameter hub, and thus results in a design with little stiffness, but one which incorporates all the manufacturing advantages of the invention.

Therefore, the preference will normally be to add stiffness to the design by incorporating a stiffener in the form of a pipe connecting the bearings and made of a material having great stiffness in relation to its weight. The helical conveyor flights are added as a cast-on feature comprising a material having a density close to the density of the liquid phase of the material to be treated, causing a buoyancy force on the submerged flights of the same magnitude as the mass forces from the flights' material, when the centrifuge operates.

The combined effect of this is that the ratio of mass of the conveyor in a submerged condition to the bending stiffness of the conveyor supported at the bearings is decreased, whereby the first critical vibration frequency of the conveyor is increased.

The flights of the conveyor are, for this and other reasons, primarily made from polyurethane.

The helical flights of the conveyor may, in cases where large loads are occurring in the transport of deposited material along the inner wall of the drum, be reinforced by cast-in plates or lamellas.

Such reinforcing members are preferably made of fiber-reinforced resins in order to reduce the mass/stiffness ratio of the reinforcement.

Friction and wear are not totally eliminated, and over time the wear of the peripheral edge of the helical flights progresses. In order not to lose the advantages associated with the fact that the flights are in contact with the inner wall of the drum, the flights of one preferred embodiment are formed in such a way that the transporting face of the flights is at an angle to the profile of the inner wall of the drum, as seen in axial cross-section, of more than 90 degrees.

Accordingly, the helical flights, at their innermost position closest to the axis, are formed in such a way that they can pivot around the point of attachment to the hub.

By having this feature, wear on the peripheral edge of the flights will cause the flights to pivot outward by action of the centrifugal force, until they reach contact with the inner wall. The angle between the flights and the profile of the inner wall will diminish, but this will not change the separation capability of the centrifuge significantly.

The pivoting action will be assisted by the pressure created by the solid material on the transport side of the flights, increasing the sealing action between the flights and the inner wall of the drum.

The above characteristics of the present invention are particularly advantageous in the converging part of the decanter centrifuge, where the deposited solids are transported out of the drum. In this part of the centrifuge, leakage between the peripheral edge of the flights and the inner wall will cause the solids to slide backwards towards the cylindrical part of the drum and consequently not be conveyed out.

This disadvantage is further diminished when the "hill", by which the solids are carried upwards towards the solids' outlet, is formed with a smaller angle of "elevation" in the areas where the centrifugal forces are at maximum, that is at the "foot of the hill" between the cylindrical and converging parts of the drum.

Therefore, in a preferred embodiment, the profile of the inner wall of the drum is made in three sections along the axis, comprising a first cylindrical part in the liquid outlet end, a second conical part with a surface angle a, and a third conical part with a surface angle p, which is greater than a.

BRIEF DESCRIPTION OF THE DRAWINGS

In the following, the invention will be described in detail referring to the attached drawings, where.

DETAILED DESCRIPTION OF PREFERRED EMBODIMENTS OF THE INVENTION

Figures 1A, 1B:
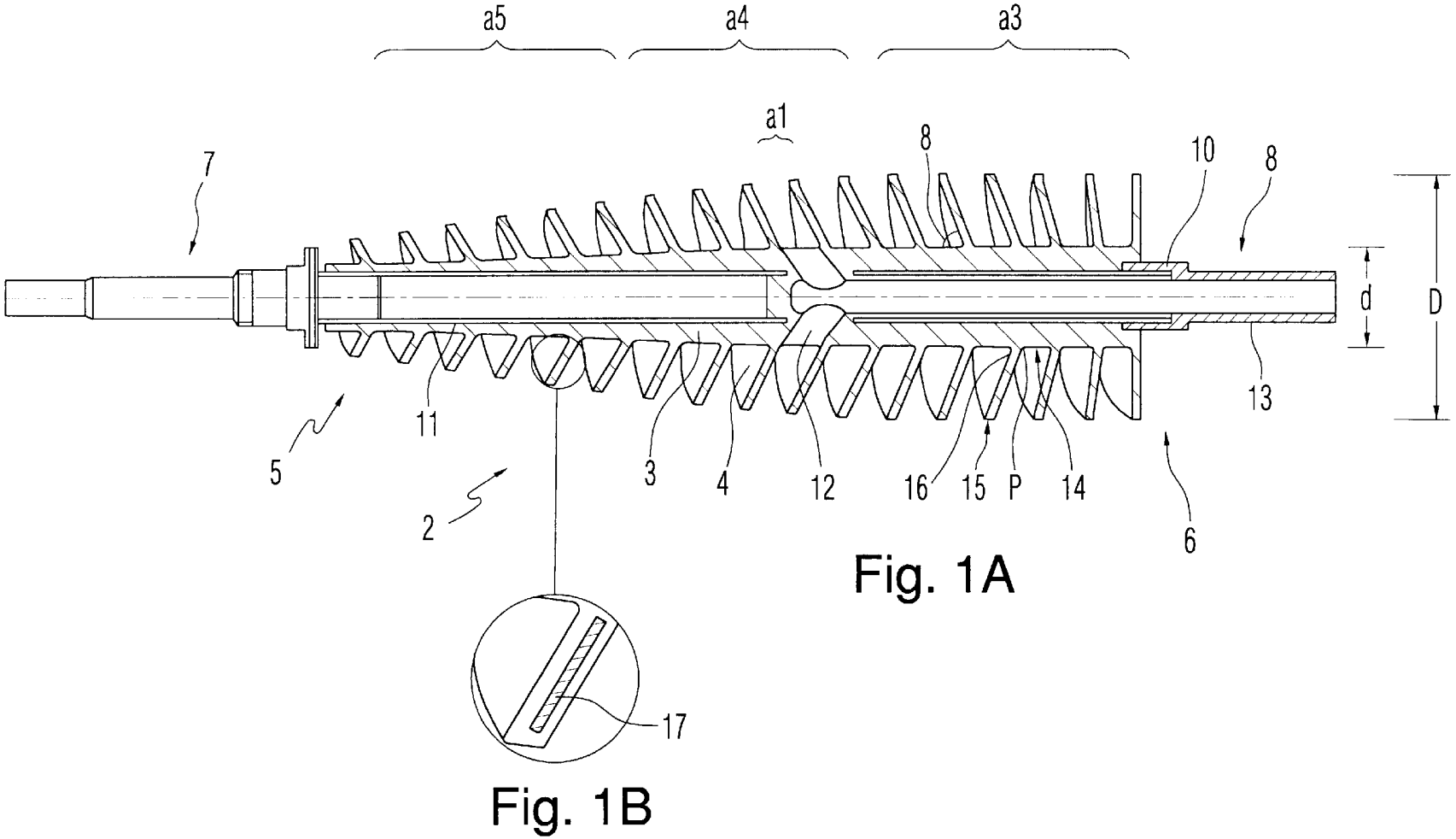
FIG. 1A shows an axial cross-section through a helical conveyor of a decanter centrifuge according to the invention.
FIG. 1B is an enlarged detailed view of a portion of a helical flight of the conveyor shown in FIG. 1A.
Figure 3:
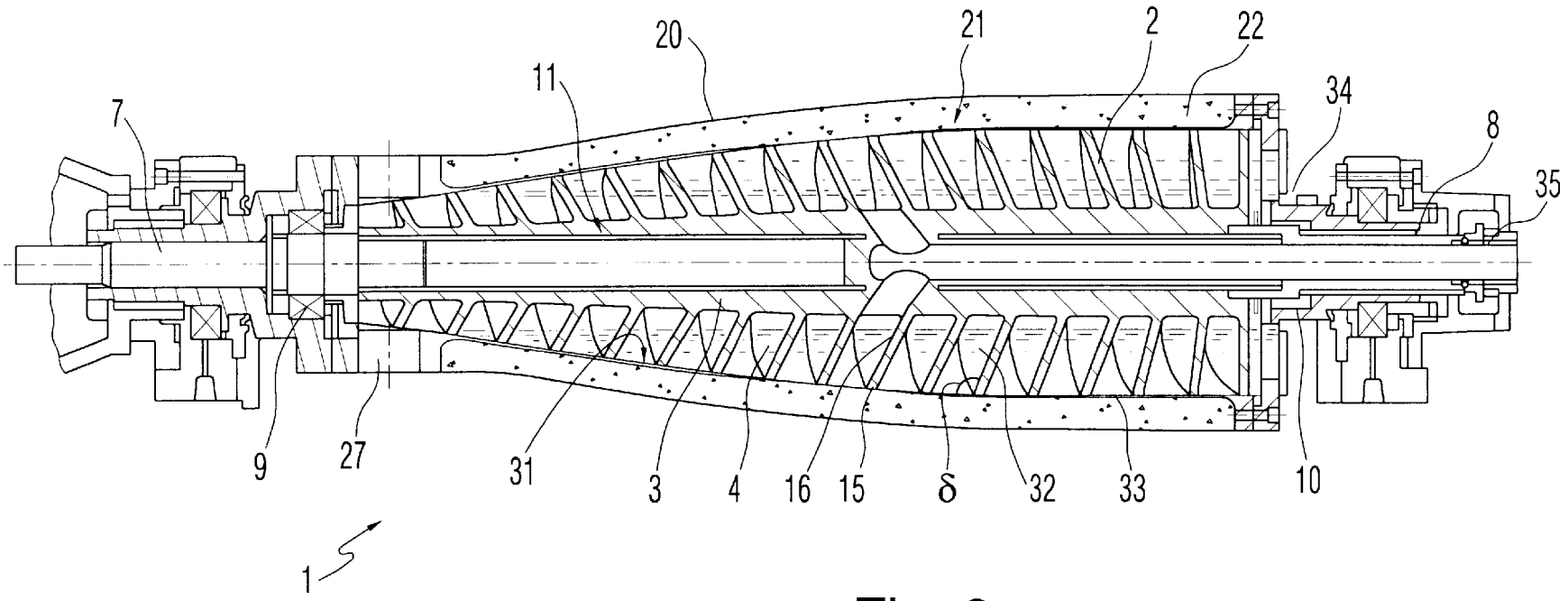
FIG. 3 is an axial cross-section through an alternative embodiment of a decanter centrifuge according co the invention.
Figures 1A, 1B:
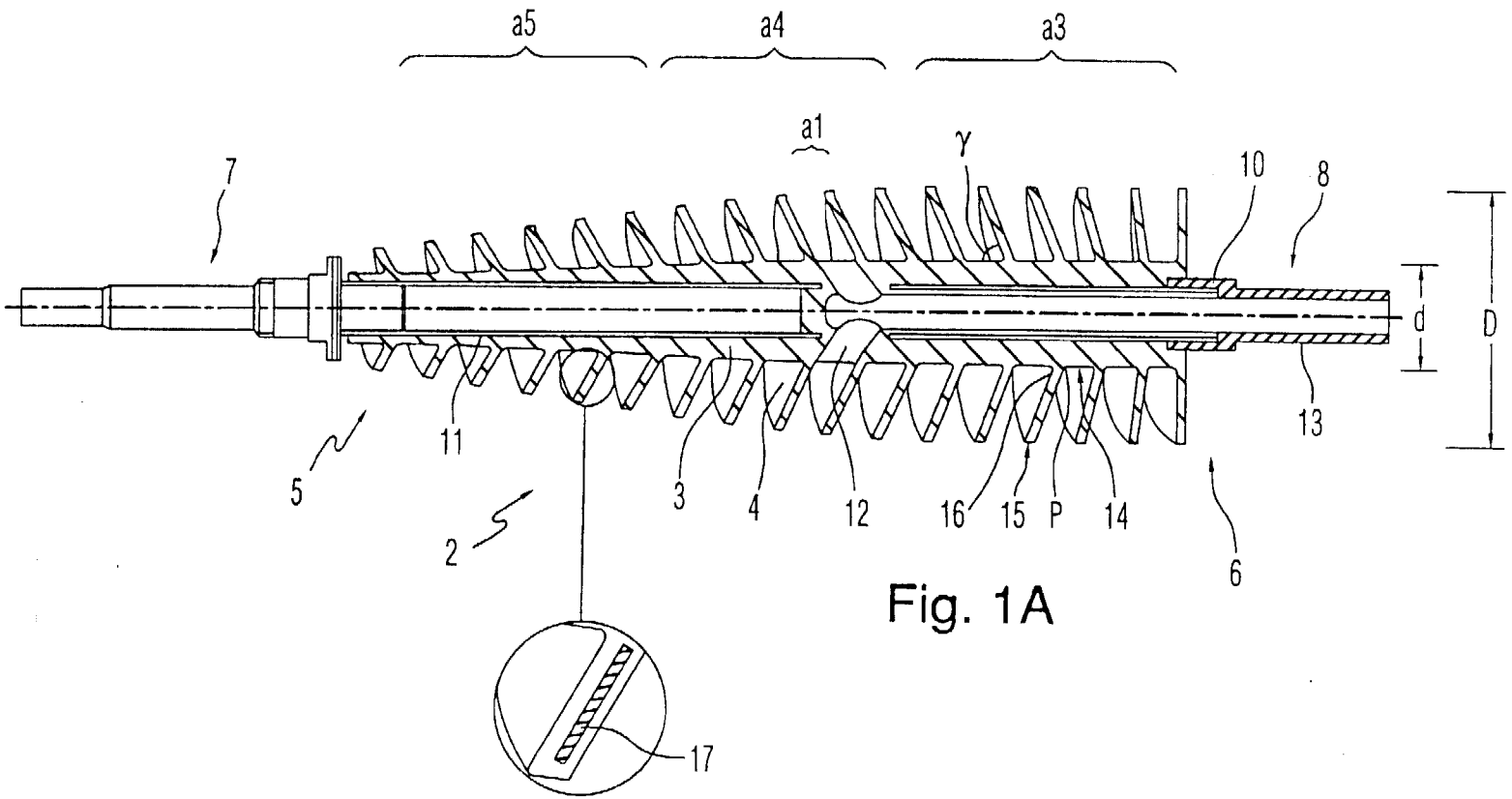
Figure 3:
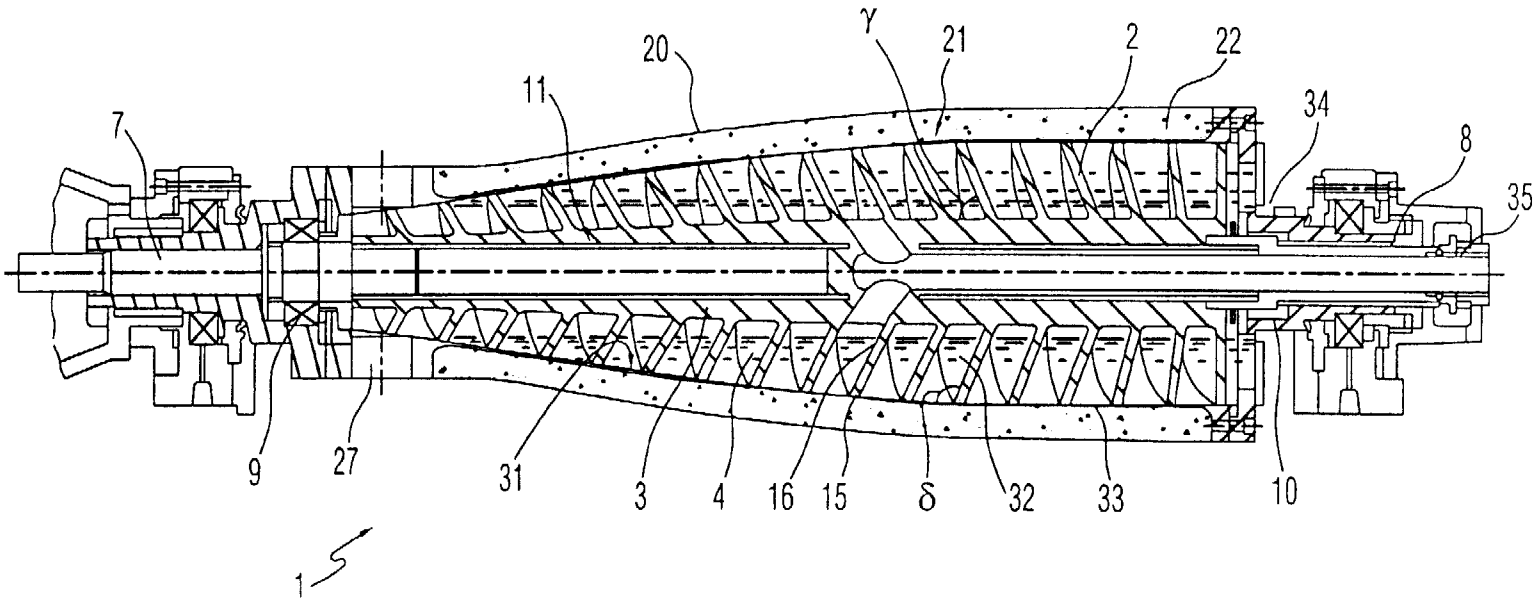

FIG. 1A illustrates a conveyor 2 for a decanter centrifuge (shown in FIG. 3). The conveyor 2 comprises a conveyor hub 3 and helical flights 4. The conveyor hub 3 and the helical flights 4 are all made of the same flexible material and are cast in one piece. The flexible material is polyurethane. Other materials having similar properties, i.e. density and wear resistance, with the ability to function at a satisfactory level in a decanter centrifuge according to the invention, may also be employed.

The conveyor hub 3 extends from a foremost end 5 to an rear end 6, and is connected to shafts 7, 8 by respective bearings 9, 10. The shafts 7 and 8 are made of steel, and an intermediate stiffener 11, made from a fiber reinforced resin material, extends the length of the conveyor hub 3. An opening 12 protrudes through the conveyor hub 3. The rear shaft 8 and its extension 13 are hollow and are fastened to the hollow intermediate stiffener 11. The hub 3 is also hollow, so that the medium to be treated can be introduced from hub 3 into the interior of the centrifuge through the opening 12.

As shown in FIG. 3, the rear, hollow shaft 8 is connected at its free end via a rotating seal 35 to a piping system (not shown) for supplying medium to be treated to hub 3.

Upstream of the opening 12, the flexible material, of which the conveyor hub is manufactured, is dimensioned to the full diameter d of the hub, along a distance a1. Apart from the distance a1, the hub 3 is hollow throughout.

The helical flights 4 extend from the outer periphery 14 of the conveyor hub 3 to the flight's outer peripheral edge 15. The helical flights 4 form two continuous helixes, exceeding from the rear end 6 of the conveyor hub to its foremost end 5. The helical flights 4 form an angle Y relative to the outer periphery 14 of the conveyor hub 3, which angle decreases gradually from approximately 90 degrees from the rear end 6 of the conveyor hub to the foremost end 5 of the hub 3.

The helical flights are in the embodiment shown able to pivot through a transition point P between the outer periphery 14 of the hub 3 and an inner edge area 16 of the flights 4. An enlarged view (FIG. 1B) shows how the helical flights may be reinforced by the introduction of cast-in stiffeners in the form of lamellas 17.

The helical flights 4 are made as two continuous helixes in order to create ideal dynamical balance. A number other than two may be chosen, provided that proper balancing devices are employed.

The outer diameter D of the helical flights 4 is constant along a first axial distance a3 from the rear end of the conveyor hub, but then decreases linearly along a second distance a4 towards the foremost end 5 of the conveyor hub 3, and then further decreases along a third distance a5. The conveyor hub likewise decreases from a diameter d and its rearmost end towards the foremost end of the hub 3.

Figure 2:
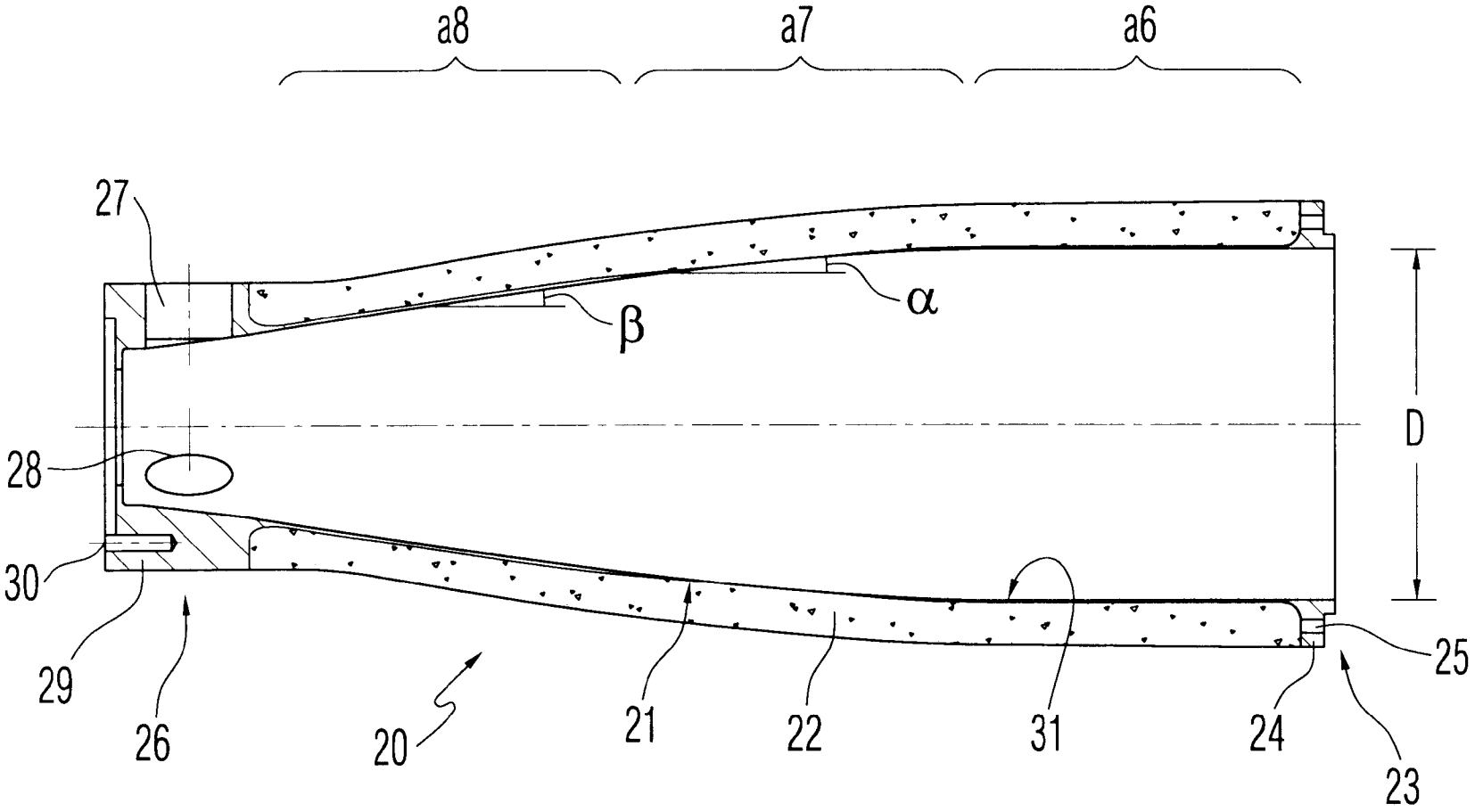
FIG. 2 is an axial cross-section through a drum of a decanter centrifuge according to the invention.

FIG. 2 illustrates a drum 20 for a decanter centrifuge according to the invention. The drum 20 comprises an inner shell 21 made from steel and an outer shell 22 made from fiber reinforced resin.

A rear end 23 of the inner shell 21 ends in a flange 24 with means 25 for fastening this flange 24 to another flange (not shown) that provides the bearing support for rotation at this end. The opposite end 26 the inner shell 21 is provided with openings 27, 28 for the outlet of the solid phase of the medium to be treated in the centrifuge. The inner shell 21 ends up at end 26 in a flange 29 with means 30 for fastening this flange to another flange (not shown) which provides the bearing support for rotation at this end (FIG. 1A). The inner shell 21 is hollow all through, so that the conveyor 2 can be accommodated into the drum 20.

As mentioned above, the outer shell 22 is made from a fiber-reinforced resin and is intended to provide stiffness and strength to the inner shell 21. On its inside 31, the inner shell is provided with a wear-resistant surface coating. The inner shell 21 has an inside diameter D equal to the outside diameter D of the helical flights 4 (FIG. 1A), and D is constant along a first axial length a6. Along a second axial length a7 following a6, the inner shell 21 has a conical section with a cone angle a of 4 degrees, and along a third axial length a8 the inner shell is likewise conical, but with a cone angle β of 8 degrees.

FIG. 3 illustrates the assembled decanter centrifuge 1 according to the invention comprising the conveyor 2 and drum 20 as illustrated in FIGS. 1A and 2, respectively. Further to this, the decanter centrifuge comprises a supporting structure of known type and driving means (not shown). The density of the material forming the helical flights 4 is approximately equal to, but slightly larger than the density of the liquid phase of the medium to be treated in the centrifuge, assuring that the outer edge of the helical flights 4 is always in contact with the inside surface 31 of the drum 20.

The front side 32 of the helical flights 4 is angled by an angle relative to the inner periphery 31 of the drum 20. During operation, the outer periphery 15 of the helical flights 4 will be worn little by little. The helical flights 4 are fastened to the conveyor hub 3 in such a manner that the angle Y between the inner edge 16 of the helical flights and the outer periphery 14 of the conveyor hub is changeable. In this way the angles can be changed at a rate according to the rate of wear of the outer edge 15 of the helical flights 4. This provides the ability of the outer edge 15 of the helical flights 4 to be always in contact with the inner periphery 31 of the drum 20. Alternatively, the angle δ can be changed by introducing angular alterations at positions along the helical flights 4 other than at the inner edge 16 at the point of attachment P.

The process of separation that is performed by the illustrated decanter centrifuge is described below:

During operation, the centrifuge rotates about its longitudinal axis at a high speed, which is limited by material strength and critical vibration frequencies of the design.

In practical terms, the highest safe speed of operation of a rotor mounted in fixed bearings is between 50% and 70% of the 1st critical frequency of the rotor, depending on the quality of balancing.

As an illustration of these conditions, the following equation gives the critical frequency of a rotor in principle.

A shaft simply supported at both ends with even thickness distribution and mass m, length between supports 1, sectional moment of inertia I and modules of elasticity E will exhibit a 1st critical frequency of vibration ω:

$$\omega = K \times \sqrt{\frac{E \times I}{m \times l^3}}, \text{ where } K = \text{constant}$$

It is easily seen that ω will increase with increasing E or decreasing m. Further it may be observed that an increase of 1 will cause a rather large reduction of ω.

In real decanter centrifuges, the lowest 1st critical speed is exhibited by he conveyor, simply because it has the highest mass (=m) in proportion to its stiffness (=EI).

A large improvement of the conveyor, however, will only reveal the next limiting factor, which is the combined 1st critical frequency of vibration of the conveyor and drum.

As the conveyor is supported by bearings relative to the drum, the mass of the conveyor will add to the mass of the drum in the equation of 1st critical frequency of the combined rotor system, and a reduction of the conveyor's weight will therefore have a positive effect on the properties of the combined rotors as well. It is, however, necessary to improve the mass/stiffness relationship for the drum, if the full improvement of the conveyor is to be taken into advantage.

The centrifuge according to the invention exhibits a drastically improvement of the 1st critical frequency of the conveyor through the application of modern light materials for the helical flights and conveyor hub and the added stiffness gained by the introduction of a tube 11 (FIG. 1A) of carbon fiber reinforced resin as a backbone in the design.

Another important point is that the speed of the drum is limited by the strength of the material by which the drum wall is manufactured, and a very large proportion of the loads on the material of the drum wall comes from the weight of the drum wall itself.

The other large load component comes from the liquid pressure on the inside of the drum.

As an illustration of this, look at the following equation giving the maximum safe speed of operation ω for a drum with an outer diameter D, filled with liquid of density ρv, and the drum material has density ρm and maximum allowable stress σ:

$$\omega = \frac{K1}{D} \times \sqrt{\frac{\sigma}{\rho v + K2 + \rho m}}, \text{ where } K1 \text{ and } K2 \text{ are constants}$$

It follows from this that an improvement of the maximum allowable stress θ or an adjacent decrease of the material density ρm will be needed to increase ω, and this is exactly the reason behind the design of the drum shell according to the invention, the fiber reinforced material applied for the outer shell having a very advantageous relation between strength and density, resulting in a rotor system of considerably higher 1st critical frequencies.

A centrifuge of drum diameter 500 mm and a length of 2 m will typically be able to reach 5000 rpm.

Sludge to be treated in the centrifuge often consists of small particles of solids suspended in a liquid, most often water, which fall towards the bottom of the container surrounding it by gravity.

By rotating, the centrifuge is capable of producing a field of gravity many times more forceful than the gravity of earth. In a centrifuge of 500 mm diameter and a speed of 5000 rpm, the centrifugal gravity field at the inside of the drum will be around 7000 times larger than the gravity of earth.

Through the feed tube 11 (FIG. 1A) and the seal arrangement 35 (FIG. 3) the sludge to be treated is introduced along the rotational axis of the centrifuge through the hollow shaft 8, further through the hollow conveyor hub 3 to the opening 12, through which it is introduced into the interior of the drum. When the centrifuge has been in operation for a time long enough to fill up the annular volume 33, the cleaned liquid phase begins to leave the drum by the weir edge 34 provided at the rear end of the drum.

At the same time, the conveyor 2 rotates slowly in relation to the drum 3 driven by a transmission (not shown) connected to the conveyor shaft 7. This causes the separated solids phase to be moved by the conveyor, as the helical flights are moving along the inside of the drum 20 "upward" along the conical sections with the angles α and β (FIG. 2), passing the "waterline" at the end of the annular volume 33 (FIG. 3), finally reaching the solids outlet openings 27, from where the solids leave the drum and are collected by chutes (not shown).

The speed of the conveyor 2 relative to the drum is dependent on the pitch of the helical flights and, naturally, on the desired dryness of the solids, and typical values are between 0.5 and 15 rpm.

The embodiments shown of conveyor, helical flights and decanter according to the invention may only be considered as examples. Other embodiments having properties within the scope of the claims may be provided. Other materials than polyurethane can be used, as well as stiffening members other than tubes. The angles α, β, γ and δ given by exact values, may take other values as well.

What is claimed is:

1. A decanter centrifuge for separating solids from a liquid medium, comprising:

a drum; and a helical conveyor rotatably mounted within the drum, said conveyor having a conveyor hub and at least one helical flight joined to the hub, wherein the at least one flight is made of a single elastomeric material, wherein said centrifuge has a liquid inlet end and a liquid outlet end of larger diameter than the inlet end and wherein said drum has an inside curved surface formed of linear sections, said section adjacent the outlet end forming a tangential angle of 0 to 8 degrees relative to a longitudinal axis of the drum, and said section adjacent the inlet end forming a tangential angle of 8 to 25 degrees relative to said longitudinal axis.

2. A decanter centrifuge for separating solids from a liquid medium, comprising:

a drum; and a helical conveyor rotatably mounted within the drum, said conveyor having a conveyor hub and at least one helical flight joined to the hub, wherein the at least one flight is made of a single elastomeric material, wherein said drum comprises an inner metal shell having a wear resistant coating on an inside surface thereof, and an outer shell made from a fiber-reinforced resin.

3. A decanter centrifuge for separating suspended solids from a liquid medium, wherein a helical conveyor is rotatably mounted within a drum and the conveyor includes a hub and at least one helical flight attached to the hub wherein the hub and the at least one helical flight are integrally formed in one piece of the same elastomeric material.

4. The decanter centrifuge according to claim 3, wherein the elastomeric material comprises a polyurethane.

5. The decanter centrifuge according to claim 3, wherein the at least one flight further comprises at least one plate or lamella disposed therein to stiffen a portion of the at least one flight.

6. The decanter centrifuge according to claim 3, wherein the at least one flight forms an angle $\gamma$ relative to an outer periphery of the hub which angle decreases gradually by approximately 90 degrees from a first end of the hub to a second end of the hub.

7. The decanter of claim 3, wherein the helical conveyor is joined to a drive shaft comprising a material having a larger modulus of elasticity than the elastomeric material.

8. The decanter of claim 7, wherein the drive shaft comprises a carbon-reinforced fiber resin and at least a portion of the drive shaft is disposed within the helical conveyor.

9. The decanter centrifuge of claim 3, wherein a portion of the at least one flight contacts the drum.

10. The decanter centrifuge of claim 3, wherein the drum has a length and an inner wall comprising at least a cylindrical section and a conical section along the length.

11. The decanter centrifuge of claim 10, wherein the conical section comprises first and second conical parts with the first conical part adjacent to the cylindrical section and having a first surface angle that is less than a second surface angle of the second conical part.

* * * * *

UNITED STATES PATENT AND TRADEMARK OFFICE

CERTIFICATE OF CORRECTION

PATENT NO. : 6,123,656

DATED : September 26, 2000

INVENTOR(S) : J. MICHELSEN

It is certified that error appears in the above-identified patent and that said Letters Patent is hereby corrected as shown below:

On the title page at "[73] Assignee": change the name of the assignee from "Incentra" to --Incentra ApS--.

On the title page at "[57] Abstract": line 9, delete "is" and insert --are--.

Col. 1, line 5, replace "State" with --States--.

Col. 1, line 32, after "the" (second occurrence) insert --one--.

Col. 1, line 37, after "the" (second occurrence) insert --other--.

Col. 1, line 54, replace "way." with --way:--.

Col. 3, line 18, replace "arrive" with --occur--.

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. :6,123,656 
DATED : Sept. 26, 2000
INVENTOR(S) : J. Michelsen

It is certified that error appears in the above-identified patent and that said Letters Patent is hereby corrected as shown below:

Col. 4, line 57, replace "a" (third occurrence) with --α–.

Col. 4, line 58, replace "p" with --β– and replace "a" (second occurrence) with --α–.

Col. 5, line 4, replace "co" with --to--.

Col. 5, line 18, replace "an" with --a--.

Col. 5, lines 19-20, delete "by respective bearings 9, 10".

Col. 5, line 40, replace "Y" with --γ--.

Col. 5, line 60, replace "and" with --at--.

Col. 6, line 2, after "26" insert --of--.

Col. 6, line 19, replace "a" with --α–.

Col. 6, line 36, after "angle" insert --δ–.

Col. 6, line 40, after "angle" replace "Y" with --γ--.

Col. 6, line 65, replace "1" with --l--.

UNITED STATES PATENT AND TRADEMARK OFFICE

CERTIFICATE OF CORRECTION

PATENT NO. :6,123,656

DATED : Sept. 26, 2000

INVENTOR(S) : J. Michelsen

It is certified that error appears in the above-identified patent and that said Letters Patent is hereby corrected as shown below:

Col. 6, line 66, replace "modules" with --modulus--.

Col. 7, line 25, replace "drastically" with --drastic--.

Col. 7, line 45, the addition sign shown in the equation after "K2" should be shown as a multiplication sign.

Col. 7, line 49, replace "θ" with --σ--.

Col. 7, line 50, replace "mm" with --ρm--.

Col. 8, line 1, delete "the food tube 11 (FIG. 1A) and".

In FIG. 1A, replace "δ" with --γ--.

In FIG. 3, add --γ-- and an indication of an angle, with a line therebetween.

1/3

3/3